US008899029B1

(12) United States Patent
Dreyer et al.

(10) Patent No.: US 8,899,029 B1
(45) Date of Patent: Dec. 2, 2014

(54) EXHAUST APPARATUS FOR DECREASING REVERSION OF COOLING LIQUID IN A MARINE PROPULSION SYSTEM

(71) Applicant: Brunswick Corporation, Lake Forest, IL (US)

(72) Inventors: Robert Dreyer, Appleton, WI (US); Mark J. Glodowski, De Pere, WI (US); Daniel B. Slanker, Redwood City, CA (US)

(73) Assignee: Brunswick Corporation, Lake Forest, IL (US)

( * ) Notice: Subject to any disclaimer, the term of this patent is extended or adjusted under 35 U.S.C. 154(b) by 134 days.

(21) Appl. No.: 13/692,931

(22) Filed: Dec. 3, 2012

(51) Int. Cl.
*F01N 3/02* (2006.01)
*B63H 21/32* (2006.01)
*B63H 21/38* (2006.01)

(52) U.S. Cl.
CPC ..... *B63H 21/32* (2013.01); *B63H 21/383* (2013.01)
USPC ..... 60/321; 60/276; 60/298; 60/320; 60/323; 440/88 J; 440/89 B; 440/89 C

(58) Field of Classification Search
USPC ..... 60/274, 276, 298, 299, 320, 323, 324; 440/88 J, 89, 89 C, 89 B, 89 R, 89 H
See application file for complete search history.

(56) References Cited

U.S. PATENT DOCUMENTS

| | | | | |
|---|---|---|---|---|
| 4,573,318 | A | 3/1986 | Entringer et al. | |
| 4,845,945 | A | 7/1989 | Widmer et al. | |
| 4,866,934 | A | 9/1989 | Lindstedt | |
| 5,109,668 | A * | 5/1992 | Lindstedt | 60/310 |
| 5,212,949 | A * | 5/1993 | Shiozawa | 60/298 |
| 6,035,633 | A * | 3/2000 | Woods | 60/310 |
| 6,644,024 | B1 * | 11/2003 | Powers et al. | 60/320 |
| 6,648,338 | B1 * | 11/2003 | Jaeger et al. | 277/591 |
| 7,217,168 | B2 * | 5/2007 | Okamoto | 440/89 C |
| 7,698,889 | B1 * | 4/2010 | Burk et al. | 60/323 |
| 7,803,026 | B2 * | 9/2010 | McKinney | 440/89 R |

* cited by examiner

*Primary Examiner* — Binh Q Tran
(74) *Attorney, Agent, or Firm* — Andrus Intellectual Property Law, LLP

(57) ABSTRACT

Apparatuses for marine propulsion systems having an internal combustion engine comprise an exhaust conduit conveying exhaust from the internal combustion engine; a cooling jacket on the exhaust conduit; and a cooling passage between the exhaust conduit and the cooling jacket. The cooling passage guides flow of cooling liquid from upstream to downstream towards a location where the cooling liquid is mixed with exhaust in the exhaust conduit. First and second baffles are axially spaced apart and extend transversely with respect to the cooling passage so as to disperse the flow of cooling liquid at the location where the cooling liquid is mixed with the exhaust, thereby reducing reversion of cooling liquid in the exhaust conduit. At least one catalyst and at least one oxygen sensor are disposed in the exhaust conduit. The oxygen sensor is adjacent to and oriented parallel to a downstream face of the catalyst so that exhaust flows perpendicularly across the sensor.

19 Claims, 4 Drawing Sheets

EXHAUST APPARATUS FOR DECREASING REVERSION OF COOLING LIQUID IN A MARINE PROPULSION SYSTEM

FIELD

The present disclosure relates to marine propulsion systems having an internal combustion engine emitting exhaust and an exhaust elbow having a cooling jacket discharging cooling liquid into the exhaust.

BACKGROUND

U.S. Pat. No. 4,573,318 discloses a marine propulsion system having an exhaust elbow having an intake exhaust passage extending upwardly from the engine and communicating through a bend with a discharge exhaust passage, and a water jacket having pockets around the exhaust passages for cooling the latter. A central channel extends longitudinally along the exterior of the exhaust passages to guide water there along to the end of the discharge exhaust passage to mix with exhaust thereat. The central channel has a pair of sidewalls extending longitudinally and laterally tapered away from each other at the outer end of the discharge exhaust passage to create an outward draw from the central channel to minimize break-up of longitudinally outward water flow and maintain the end tip of the discharge exhaust passage dry and prevent water ingestion and creeping back into the discharge exhaust passage due to pulsations of the engine. Dam and port structure is also provided enabling faster heating of the exhaust passage and in turn minimizing condensation within the elbow which may otherwise ingest back into the engine.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure arose during research and development of marine propulsion systems having an internal combustion engine emitting exhaust and an exhaust elbow having a cooling jacket discharging cooling liquid such as water into the exhaust.

In some examples, apparatuses for a marine propulsion system having an internal combustion engine comprise an exhaust conduit conveying exhaust from the internal combustion engine; a cooling jacket on the exhaust conduit; and a cooling passage between the exhaust conduit and the cooling jacket. The cooling passage guides flow of cooling liquid from upstream to downstream towards a location where the cooling liquid is mixed with exhaust in the exhaust conduit. First and second baffles are axially spaced apart and extend transversely with respect to the cooling passage so as to disperse the flow of cooling liquid at the location where the cooling liquid is mixed with the exhaust, thereby reducing reversion of cooling liquid in the exhaust conduit.

In some examples, apparatuses for a marine propulsion system having an internal combustion engine comprise an exhaust conduit conveying exhaust from the internal combustion engine; a catalyst disposed in the exhaust conduit; and an oxygen sensor in the exhaust conduit. The oxygen sensor is adjacent to a downstream face of the catalyst. The oxygen sensor is oriented parallel to the downstream face of the catalyst so that exhaust flows perpendicularly across the sensor.

BRIEF DESCRIPTION OF THE DRAWINGS

Examples of apparatuses for cooling exhaust components of marine engines are described with reference to the following figures. The same numbers are used throughout the figures to reference like features and components.

DETAILED DESCRIPTION

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
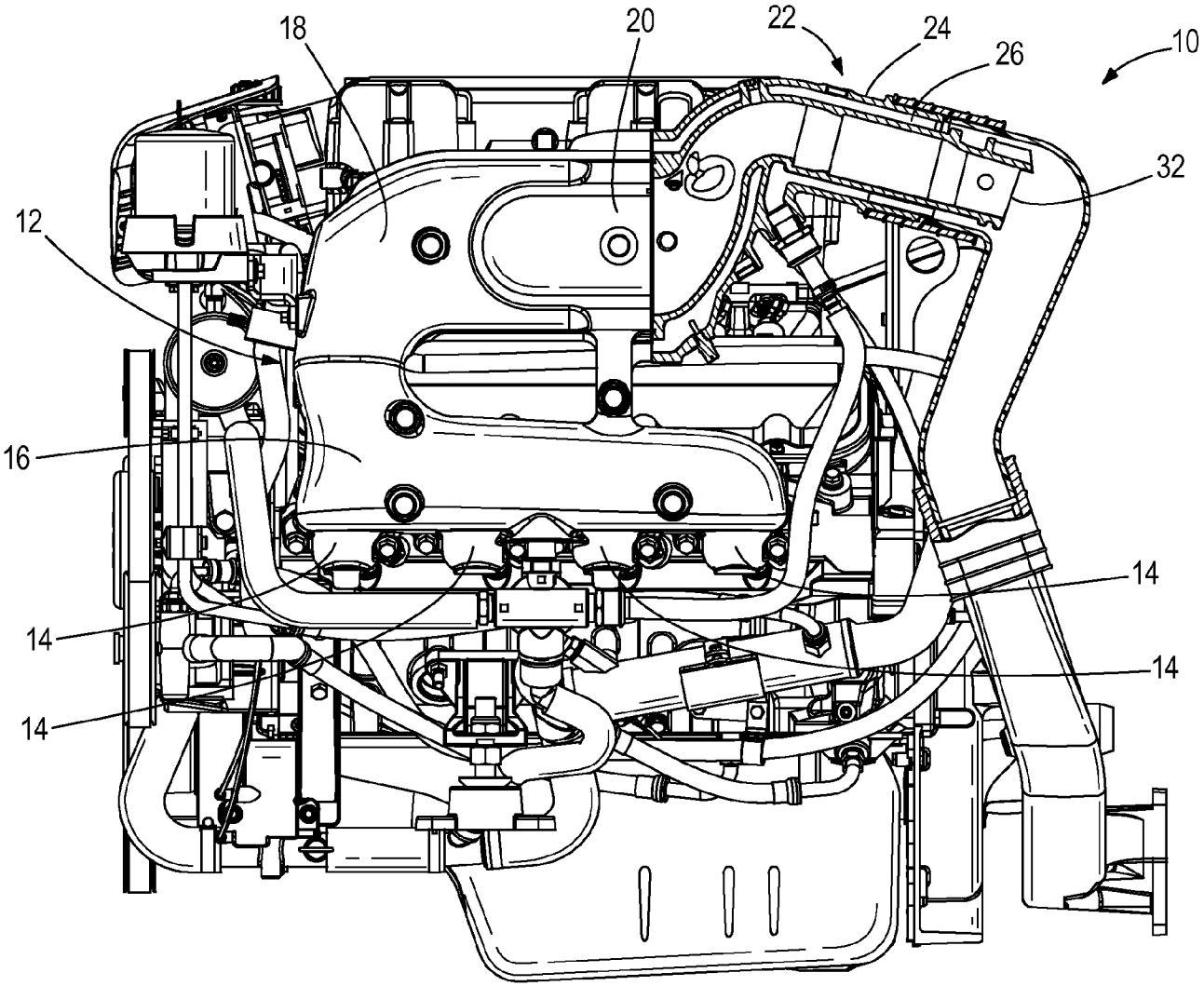
FIG. 1 is a partially sectioned view of a marine propulsion system having an internal combustion engine emitting exhaust and an exhaust elbow discharging engine coolant liquid into the exhaust.
Figure 2:
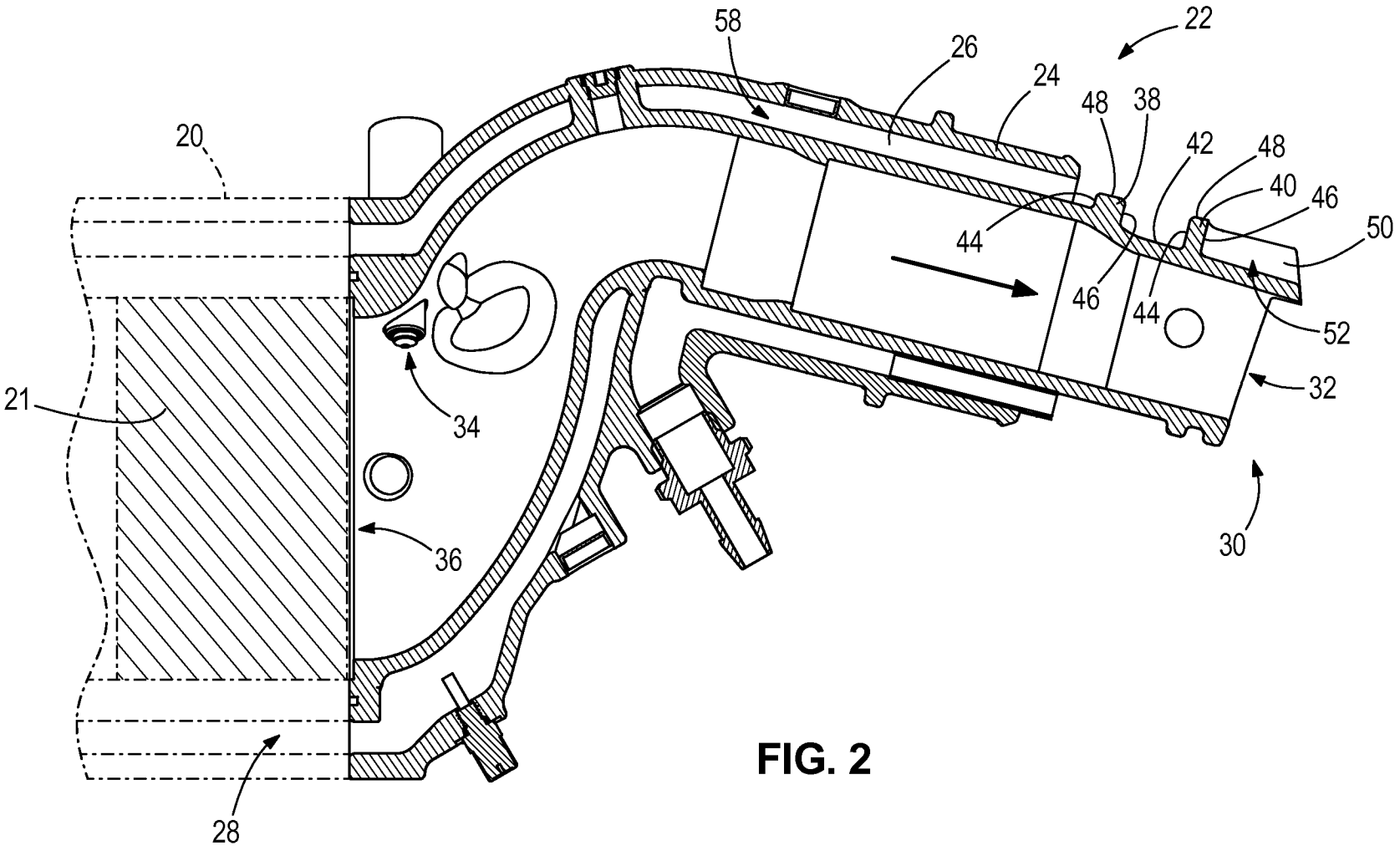
FIG. 2 is a detailed sectional view of the exhaust elbow.

FIGS. 1 and 2 depict portions of an exhaust apparatus 10 for an internal combustion engine 12 on a marine vessel. The exhaust system 10 can be configured for a stern drive or inboard catalyst-equipped marine propulsion system; however the present invention is not necessarily limited for use with this type of marine propulsion system. A plurality of exhaust ports 14 receives bulk exhaust gas from the internal combustion engine 12. The exhaust is conveyed through the exhaust ports 14 and mixed in an exhaust manifold 16. From the exhaust manifold 16, the exhaust is conveyed downstream through a series of exhaust conduits including a header 18 and a catalyst housing 20, in which a catalyst 21 (FIG. 2) is located for treating the exhaust. The exhaust flows through the catalyst 21 in the catalyst housing 20 and then into another downstream exhaust conduit, which in this example is an exhaust elbow 22. The exhaust in the exhaust elbow 22 is cooled by cooling liquid, typically seawater, pumped peripherally through a cooling jacket 24 along the outer surfaces of the exhaust elbow 22. A cooling passage 26 is defined between the exhaust elbow 22 and the cooling jacket 24 for guiding flow of the cooling liquid, from upstream 28 to downstream 30 towards the location 32 where the cooling liquid is mixed with the exhaust in the exhaust elbow 22. Thereafter, a mixture of cooling liquid and exhaust is conveyed from the location 32 for discharge via a downstream exhaust outlet (not shown), which can be located at for example a propeller housing for the marine vessel or through the transom of the vessel. The location of discharge can vary and is not critical.

Referring to FIG. 2, a post-catalyst oxygen sensor 34 is disposed in the exhaust apparatus 10. More specifically, the oxygen sensor 34 extends into the exhaust elbow 22 and is positioned adjacent to a downstream face 36 of the catalyst 21. The oxygen sensor 34 is oriented parallel to the noted downstream face 36 so that exhaust flows perpendicularly across the oxygen sensor 34.

Figure 3:
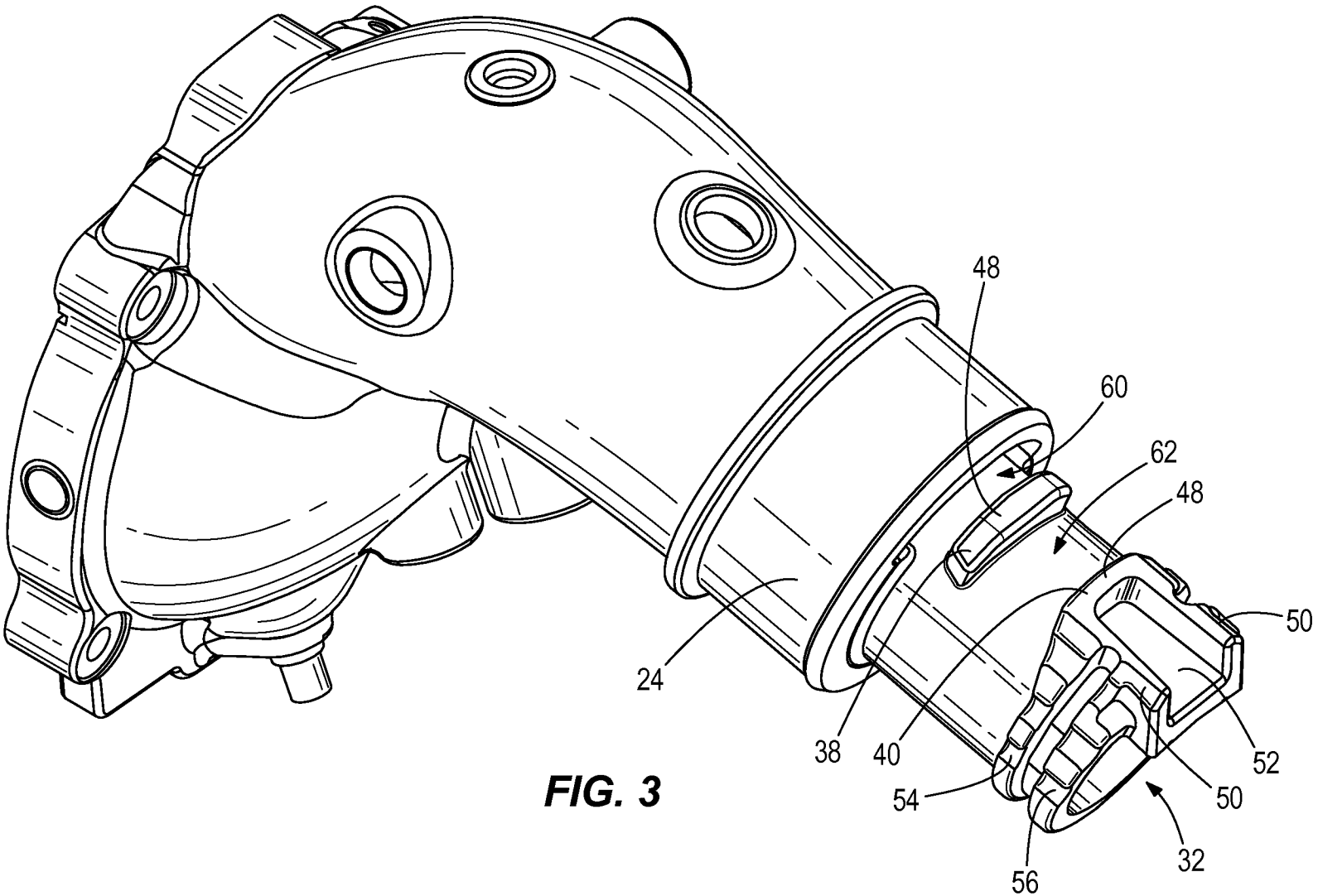
FIG. 3 is a perspective view of an exhaust passage on the exhaust elbow.
Figure 4:
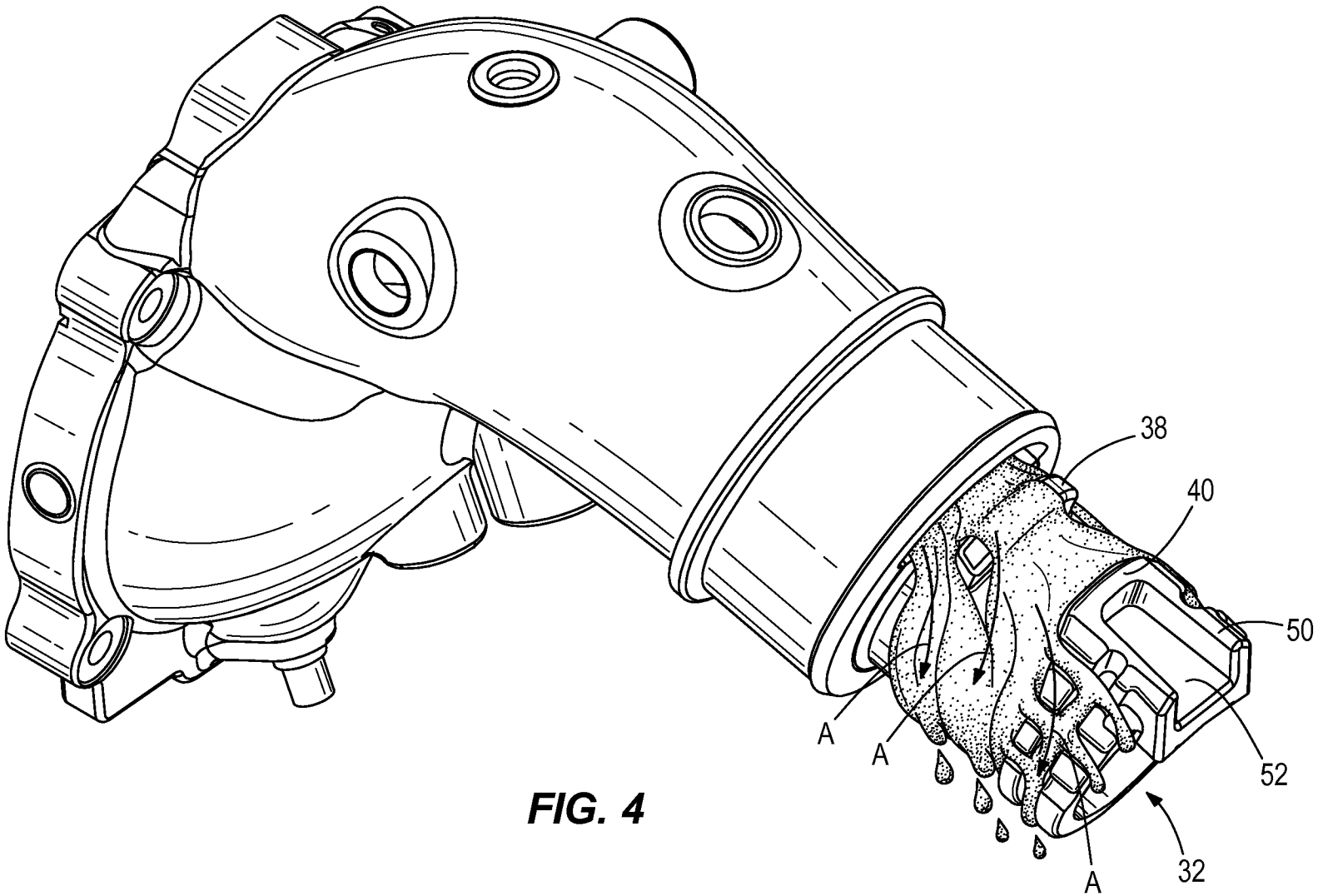
FIG. 4 is a perspective view like FIG. 3, showing flow of cooling liquid there along.

Referring to FIGS. 3 and 4, first and second baffles 38, 40 are located on the exterior surface 42 of the exhaust elbow 22. The first and second baffles 38, 40 are axially spaced apart and extend transversely with respect to the cooling passage 26 so as to disperse the flow of cooling liquid from cooling passage 26 at the location 32 where cooling liquid is mixed with the exhaust. In the example shown, the first and second baffles 38, 40 are parallel to each other. Both of the first and second baffles 38, 40 define a ridge having upstream and downstream radially extending side faces 44, 46 and a top face 48 that extends between the side faces 44, 46. The first baffle 38 and second baffle 40 only partially circumferentially extend around the top portion of the exhaust elbow 22. The second baffle 40 circumferentially extends between axially extending sidewalls 50 that together define a channel 52 located downstream of the second baffle 40. Third and fourth baffles 54, 56 are located downstream of the first and second baffles 38, 40. The third and fourth baffles 54, 56 both transversely extend with respect to the noted channel 52 and partially circumferentially around the bottom portion of the exhaust elbow 22. The first and second baffles 38, 40 are located downstream of the cooling passage 26. The first baffle 38 is spaced apart from an inside surface 58 of the cooling passage 26 such that a radial space 60 is defined therebetween. An additional axial space 62 is defined between the first and second baffles 38, 40 for cooling liquid to flow circumferentially downwardly along the exterior surface 42 of the exhaust elbow 22, as shown at arrows A.

Through research and development, the present inventors have found that the above described apparatus 10 beneficially reduces reversion of cooling liquid in aft engine exhaust rigging. Damaging effects of reversion of cooling liquid on the oxygen sensor 34 are minimized by maximizing the distance of the oxygen sensor 34 from the location 32 of mixing. First and second baffles 38, 40 mitigate the magnitude of reversion of cooling liquid in the exhaust elbow 22 without necessarily requiring lengthening or other dimensional changes in the exhaust elbow 22. The first and second baffles 38, 40 also minimize cascading of cooling liquid at the location 32 in front of the exhaust during engine idle. Such cascading of cooling liquid was found by the inventors to disadvantageously enhance reversion of cooling liquid. Cooling liquid is advantageously directed towards the lower portion of exhaust elbow 22 at arrows A along the exterior surface 42 thereof at and between baffles 38, 40 to avoid the noted cascading effect.

In the foregoing description, certain terms have been used for brevity, clarity, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. An apparatus for a marine propulsion system having an internal combustion engine, the apparatus comprising:

an exhaust conduit that is configured to convey exhaust from the internal combustion engine;

a cooling jacket on the exhaust conduit;

a cooling passage between the exhaust conduit and the cooling jacket, the cooling passage configured to guide flow of cooling liquid from upstream to downstream towards a location where the cooling liquid is mixed with exhaust in the exhaust conduit; and first and second baffles on an exterior of the exhaust conduit, wherein the first and second baffles are axially spaced apart and extend transversely with respect to the cooling passage so as to disperse the flow of cooling liquid at the location where the cooling liquid is mixed with the exhaust, thereby reducing reversion of cooling liquid in the exhaust conduit;

wherein the first baffle comprises a ridge that transversely extends along a top portion of the exhaust conduit, the ridge having an upstream radially extending side face that also extends transversely to the cooling passage along the top portion of the exhaust conduit.

2. The apparatus according to claim 1, wherein the first and second baffles are parallel to each other.

3. The apparatus according to claim 1, wherein the ridge has a downstream radially extending side, face and a top face that axially extends between the upstream and downstream radially extending side faces.

4. The apparatus according to claim 1, wherein the ridge extends only partially circumferentially around the top portion of the exhaust conduit.

5. The apparatus according to claim 1, comprising a channel disposed downstream of the second baffle.

6. The apparatus according to claim 5, wherein the channel is defined by axially extending sidewalls.

7. The apparatus according to claim 6, wherein the second baffle circumferentially extends between the sidewalls along the top portion of the exhaust conduit.

8. The apparatus according to claim 6, comprising a third baffle located downstream of the first and second baffles and transversely extending with respect to the channel.

9. The apparatus according to claim 8, comprising a fourth baffle located downstream of the third baffle and transversely extending with respect to the channel.

10. The apparatus according to claim 1, wherein the second baffle comprises a ridge that extends around the top portion of the exhaust conduit.

11. The apparatus according to claim 10, wherein the ridge of the second baffle has upstream and downstream radially extending side faces, and a top face axially extending between the side faces.

12. The apparatus according to claim 1, wherein the first and second baffles are located downstream of the cooling passage.

13. The apparatus according, to claim 12, wherein the first and second baffles are radially spaced apart from an inside surface of the cooling passage such that a radial space is defined there between.

14. The apparatus according to claim 12, wherein an axial space is defined between the first and second baffles for cooling liquid to flow circumferentially downwardly along an exterior surface of the exhaust conduit.

15. The apparatus according to claim 1, wherein the exhaust conduit comprises an exhaust elbow.

16. The apparatus according to claim 1, comprising a catalyst in the exhaust conduit and an oxygen sensor in the exhaust conduit, wherein the oxygen sensor is adjacent to a downstream face of the catalyst.

17. The apparatus according to claim 16, wherein the oxygen sensor is oriented parallel to the downstream face of the catalyst so that exhaust flows perpendicularly across the sensor.

18. An apparatus for a marine propulsion system having an internal combustion engine, the apparatus comprising:

an exhaust conduit that is configured to convey exhaust gases from the internal combustion engine;

a cooling jacket that is disposed on the exhaust conduit;

a cooling passage that is defined between the exhaust conduit and the cooling jacket, wherein the cooling passage is configured to guide flow of cooling liquid from upstream to downstream towards a location where the cooling liquid is mixed with the exhaust gases in the exhaust conduit;

an upstream first baffle and a downstream second baffle that is axially spaced apart from the first baffle on the exhaust conduit; and a channel that is disposed downstream of the second baffle, wherein the channel is defined between sidewalls that extend parallel to the exhaust conduit, and wherein the second baffle extends between the sidewalls along a top portion of the exhaust conduit;

wherein the first and second baffles each extend transversely with respect to the cooling passage so as to disperse the cooling liquid at the location where the cooling liquid is mixed with the exhaust, thereby reducing reversion of the cooling liquid in the exhaust conduit;

wherein the first and second baffles each comprise a ridge that extends along the top portion of the exhaust conduit, the ridge having an upstream radially extending side face that also transversely extends to the cooling passage.

19. The apparatus according to claim 18, further comprising a third baffle that is located downstream of the first and second baffles and that transversely extends with respect to the channel and a fourth baffle that is located downstream of the third baffle and that transversely extends with respect to the channel.

* * * * *

UNITED STATES PATENT AND TRADEMARK OFFICE

CERTIFICATE OF CORRECTION

PATENT NO. : 8,899,029 B1
APPLICATION NO. : 13/692931
DATED : December 2, 2014
INVENTOR(S) : Robert Dreyer, Mark J. Glodowski and Daniel B. Slanker It is certified that error appears in the above-identified patent and that said Letters Patent is hereby corrected as shown below:

In the Claims

In Claim 3, Column 4, Line 25: Delete the "," between "side" and "face".

Signed and Sealed this
Fifth Day of May, 2015

Michelle K. Lee

Michelle K. Lee
*Director of the United States Patent and Trademark Office*